US007331260B2

(12) United States Patent
Cheng

(10) Patent No.: US 7,331,260 B2
(45) Date of Patent: Feb. 19, 2008

(54) ROTARY WRENCHING TOOL WITH A DRIVING HEAD

(76) Inventor: Chin-Shun Cheng, No.37-2, Ching-Dau 1st Street, Taichung (TW) 404

( * ) Notice: Subject to any disclaimer, the term of this patent is extended or adjusted under 35 U.S.C. 154(b) by 0 days.

(21) Appl. No.: 11/432,203

(22) Filed: May 12, 2006

(65) Prior Publication Data

US 2007/0261519 A1 Nov. 15, 2007

(51) Int. Cl.
*B25B 13/06* (2006.01)

(52) U.S. Cl. ..... 81/121.1; 81/119; 81/124.2

(58) Field of Classification Search ..... 81/119, 81/121.1, 124.2
See application file for complete search history.

(56) References Cited

U.S. PATENT DOCUMENTS

| | | | | |
|---|---|---|---|---|
| 3,979,979 | A * | 9/1976 | Grabovac | 81/124.4 |
| 5,832,792 | A * | 11/1998 | Hsieh | 81/124.6 |
| 6,098,501 | A * | 8/2000 | Sundstrom | 81/121.1 |
| 7,000,505 | B2 * | 2/2006 | Hsien | 81/121.1 |
| 7,168,347 | B2 * | 1/2007 | Hsieh | 81/186 |
| 2004/0255728 | A1 * | 12/2004 | Hsieh | 81/186 |

* cited by examiner

*Primary Examiner*—Joseph J. Hail, III
*Assistant Examiner*—Shantese McDonald

(57) ABSTRACT

This invention relates to a driving head of rotary wrenching tools, the driving head can be a sleeve or directly implemented on the wrench, the driving head has an opening with grooves, forefront surfaces and concavities implemented inside the opening, the forefront surfaces are implemented individually in-between the grooves, and one concavity is implemented on each forefront surface, with which varieties of work pieces in different shapes can be tightly fitted into.

24 Claims, 12 Drawing Sheets

ROTARY WRENCHING TOOL WITH A DRIVING HEAD

FIELD OF THE INVENTION

This invention relates to a driving head of rotary wrenching tools, specifically the one which has an opening with grooves, forefront surfaces and concavities implemented inside, which is capable for varieties of work pieces in different shapes to be tightly fitted into.

BACKGROUND OF THE INVENTION

As what have been acknowledged, the current patent of driving head of rotary wrenching tools structured for fitting varieties of work pieces in different shapes such as U.S. Pat. No. 3,354,757, U.S. Pat No. 3,657,516 and U.S. Pat. No. 5,388,486 is having a sleeve on the driving head, twelve equally spaced convexities are angularly implemented inside the sleeve, with which varieties of work pieces in different shapes such as gear type or hexagonal type work pieces can be fit into the sleeve and rotated. In spite of the advantages of the three patents mentioned above, there are shortcomings for the three patents on the action of rotating as following: although there are twelve convexities inside the sleeve to accommodate varieties of bolt in different shapes, but the possibility for the sleeve to work on hexagonal bolts is very high because hexagonal bolts is the most prevalent bolts in the market; when the sleeve rotates the hexagon bolt, the two of the twelve convexities contact with the side of the six hexagon bolt, which will produce a gap in-between, then instability and damage are to be created.

SUMMARY OF THE INVENTION

This invention is about a driving head of rotary wrenching tools, which is capable for varieties of work pieces in different shapes to be tightly fitted into with improvement on tight fitness. The structure of this invention is that the driving head has an opening with grooves, forefront surfaces and concavities implemented inside; more specifically, the forefront surfaces are implemented individually in-between the grooves, and one concavity is implemented on the center of each forefront surface, the concavities is parallel to the central axis, which is deep enough to accommodate varieties of work pieces in different shapes for tight fitness.

BRIEF DESCRIPTION OF THE DRAWINGS

FIG. 1-*a* is a front plan view of FIG. 1.

DETAILED DESCRIPTION OF THE PREFERRED EMBODIMENT

Figure 1A:
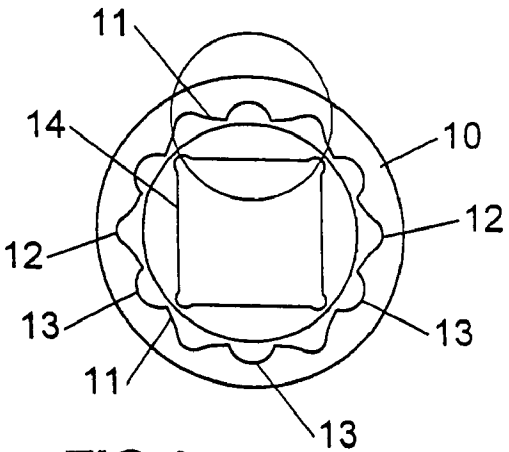
FIG. 1 is a 3-dimensional view of the sleeve of the present invention.
Figure 1:
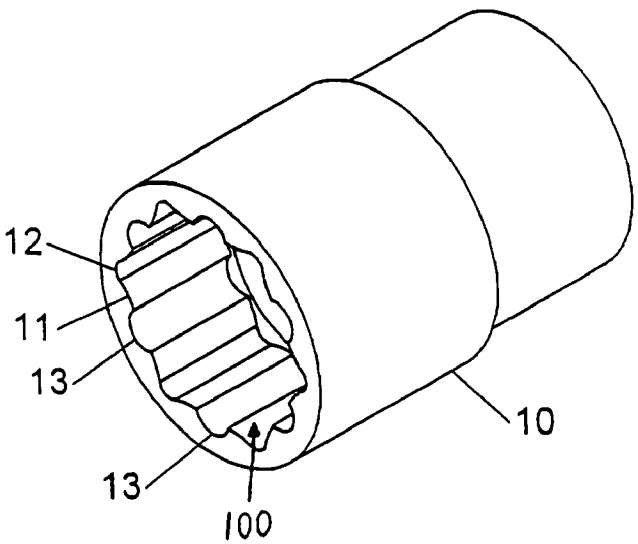

As shown on FIG. 1, this invention is about a driving head of rotary wrenching tools, the driving head 10 has two opposite ends and a central axis which connects the two ends, at least one end of the driving head 10 has an opening 100 extending along the central axis, the opening 100 is for fitting work pieces. The opening 100 has plurality grooves 12 that are distributed equidistant along the inner surface of the opening, the grooves 12 extend along the central axis. Every two adjacent grooves 12 forms a forefront surface 11, the forefront surface 11 is closer to the central axis than the groove 12. At least a concavity 13 is implemented on the center of each forefront surface 11, the extending direction of the concavity 13 is also parallel to the central axis and is deep enough to accommodate the extrusion parts of work pieces. In the embodiment shown on FIGS. 1 and 1*a*, the driving head 10 is a sleeve, one end of the sleeve has an opening 100 for purpose of fitting work pieces, the other end of the sleeve has a square hole 14 for fitting other tools, every forefront surface 11 has one concavity 13, the forefront surface 11 can be a flat surface or a curved surface. On FIG. 1, the forefront surface 11 is an arc surface tangent to the arc surface of the groove 12.

Figure 2:
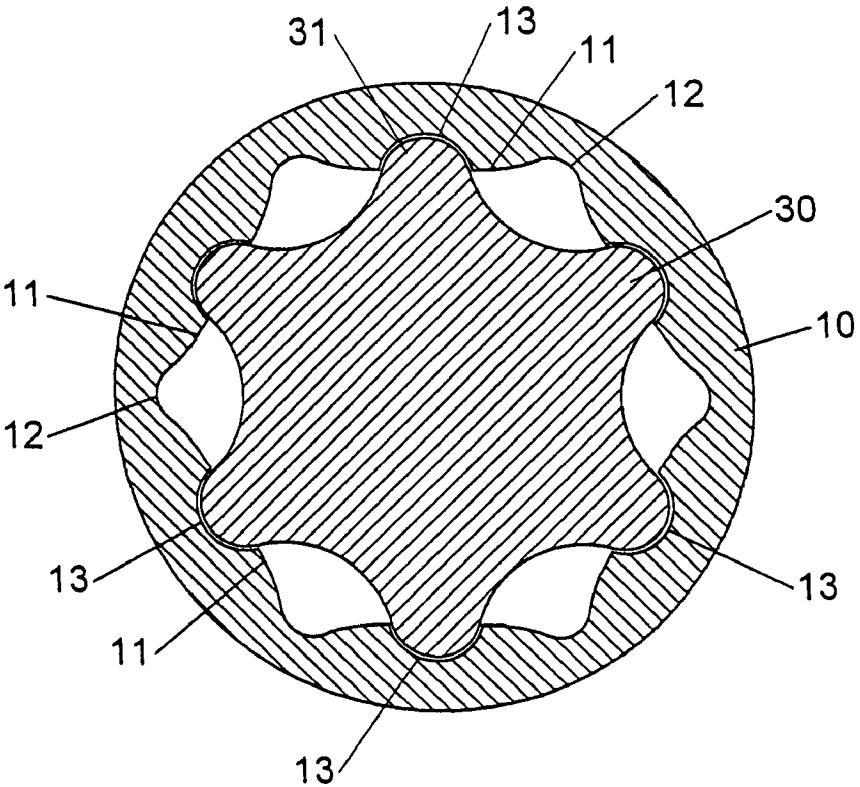
FIG. 2 shows the combination status of the work piece and the driving head of the invention.
Figure 3:
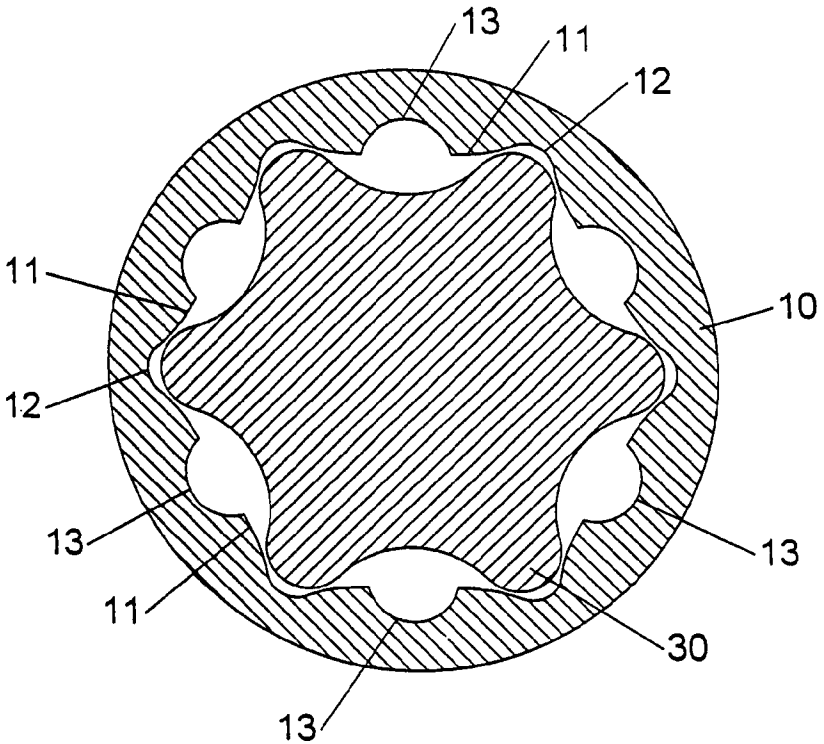
FIG. 3 shows the combination status of the work piece and the driving head of the invention.
Figure 4:
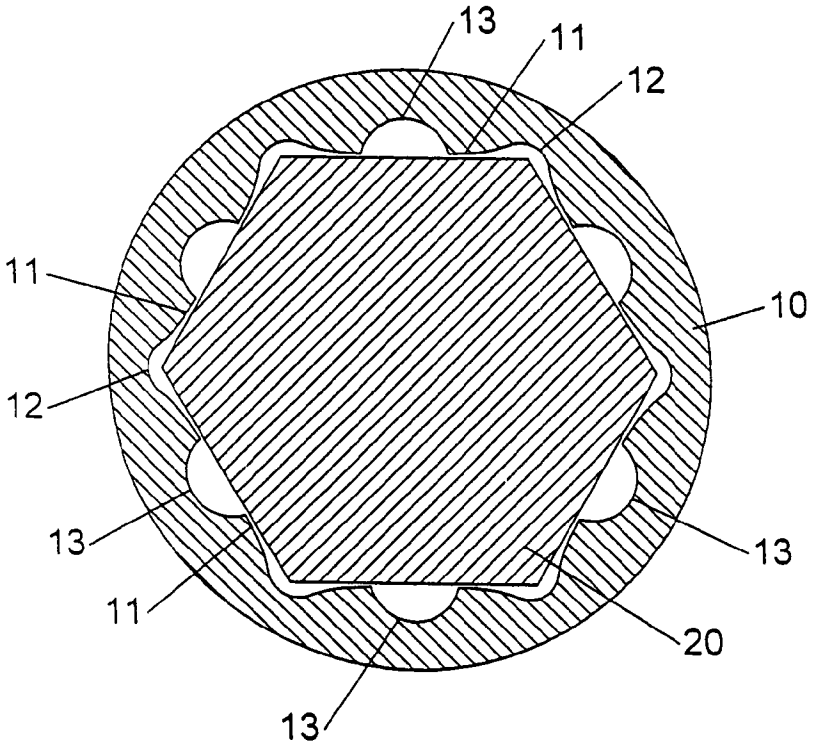
FIG. 4 shows the combination status of the work piece and the driving head of the invention.
Figure 5:
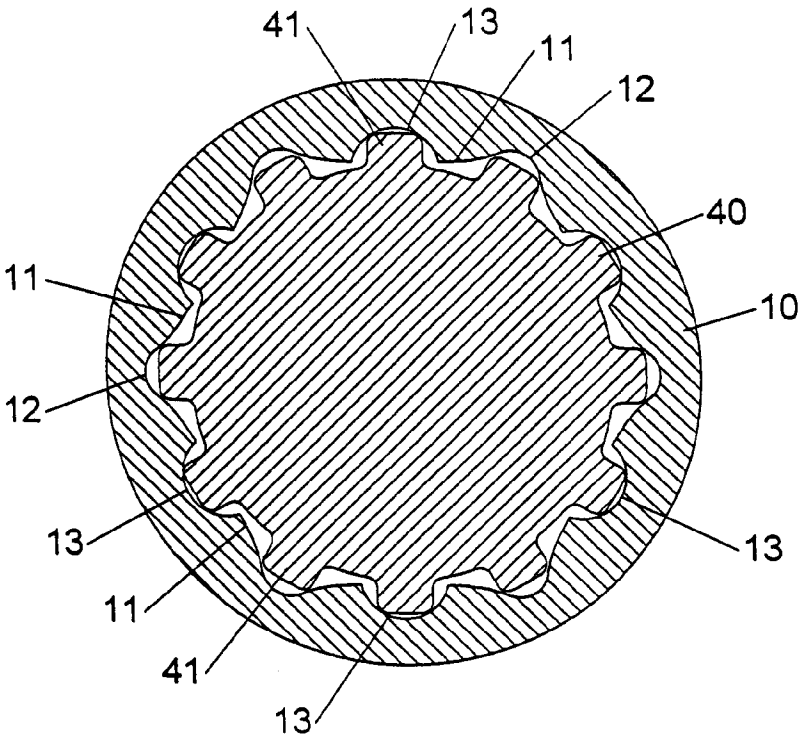
FIG. 5 shows the combination status of the work piece and the driving head of the invention.
Figure 6:
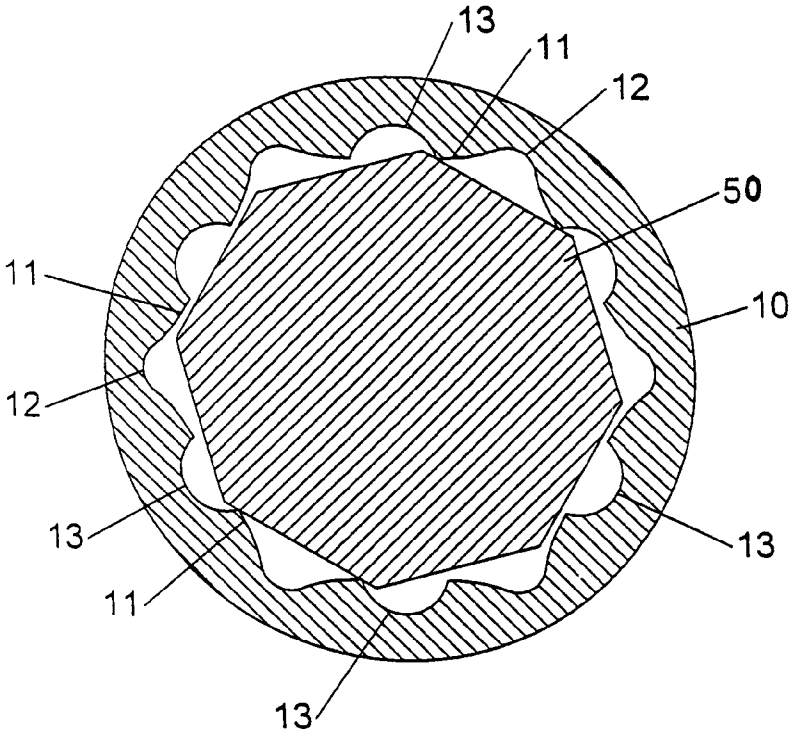
FIG. 6 shows the combination status of the work piece and the driving head of the invention.
Figure 7:
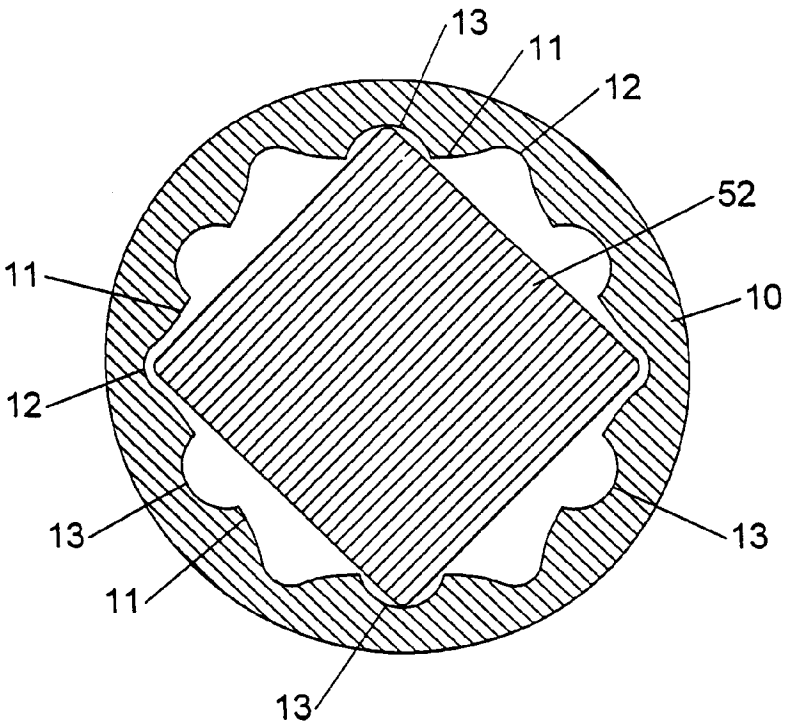
FIG. 7 shows the combination status of the work piece and the driving head of the invention.
Figure 8:
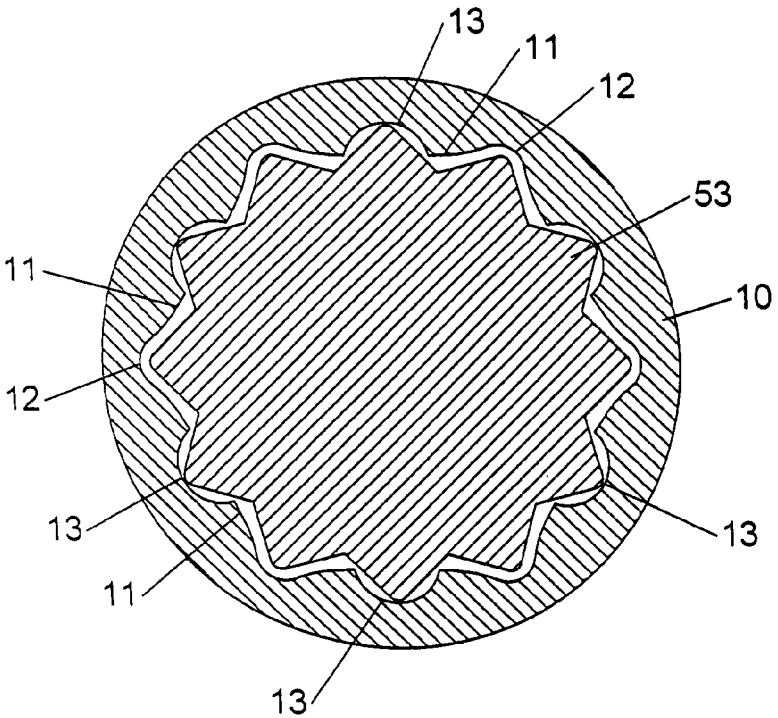
FIG. 8 shows the combination status of the work piece and the driving head of the invention.
Figure 9:
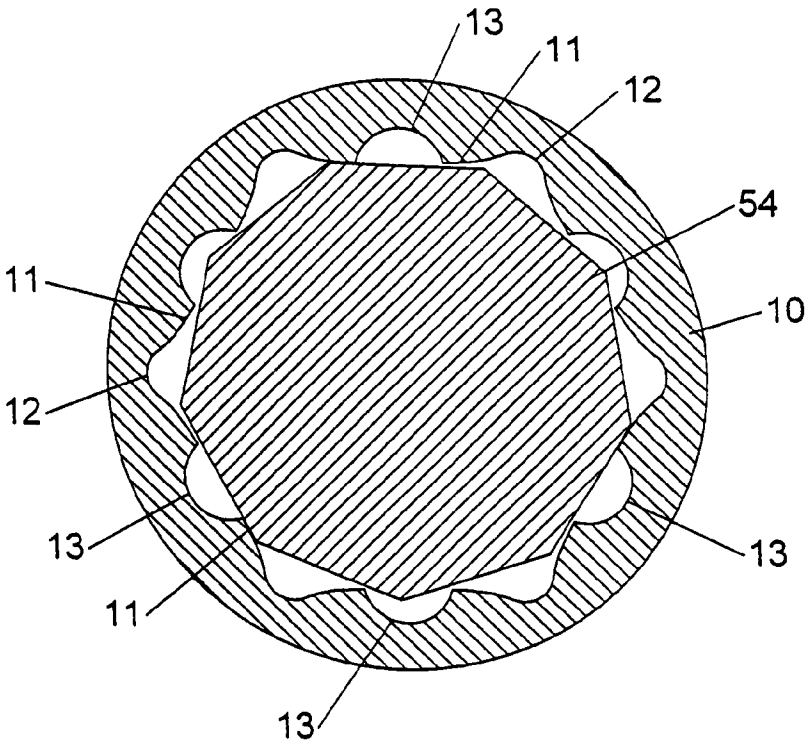
FIG. 9 shows the combination status of the work piece and the driving head of the invention.
Figure 10:
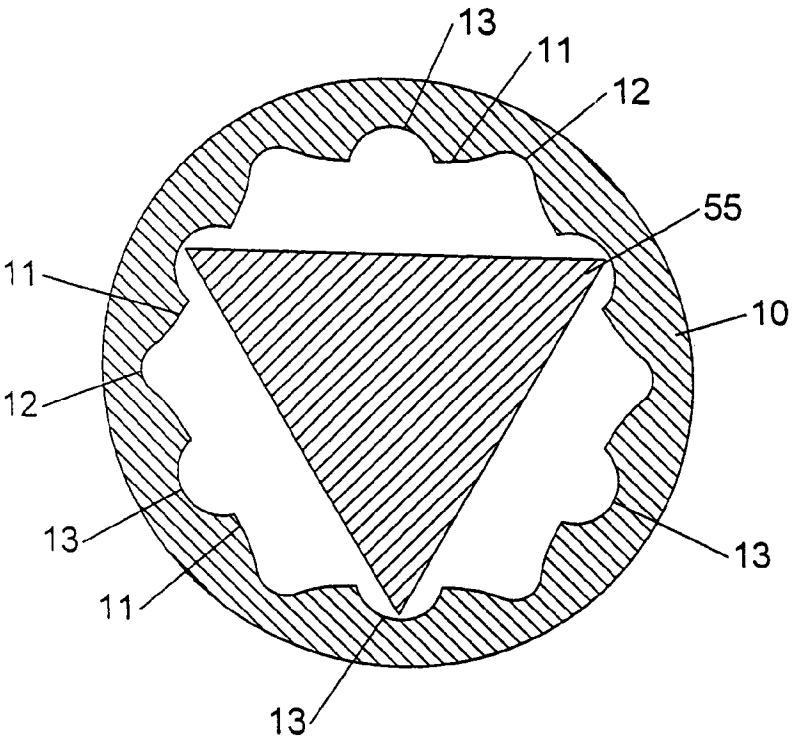
FIG. 10 shows the combination status of the work piece and the driving head of the invention.

As shown on FIG. 2, the inside of the concavities 13 are arc surfaces that will fit the round extrusions 31 of the work piece 30. As shown on FIGS. 3 and 4, the inside of the grooves 12 are arc surfaces that will fit not only the round extrusions 31 of the work piece 30 but also polygonal work piece 20. When the grooves 12 and the concavities 13 are both implemented, that a work piece 40 with plurality of extruded teeth 41 can be fitted into as shown on FIG. 5; or an octagonal work piece 50 can be fitted into as shown on FIG. 6; or a quadrangular work piece 52 can be fitted into as shown on FIG. 7; or an asteroid shape of work piece 53 can be fitted into as shown on FIG. 8; or a nine sides polygonal work piece 54 can be fitted into as shown on FIG. 9; or a trigonal work piece 55 can be fitted into as shown on FIG. 10.

Figure 11:
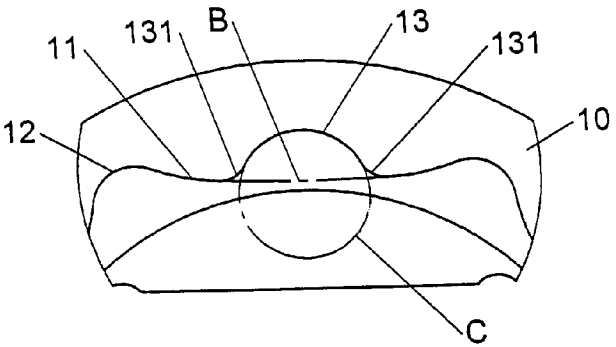
FIG. 11 is a partial enlarged view of another embodiment of the invention.

As shown on FIG. 11, the surface connecting the forefront surface 11 and the concavities 13 is shaped as a round corner 131.

Figure 12:
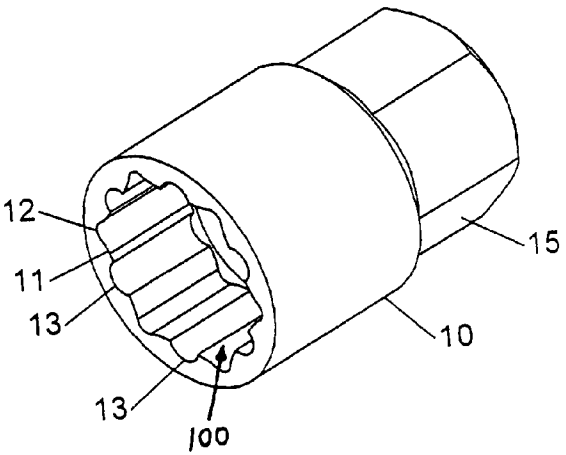
FIG. 12 is a partial enlarged view of another embodiment of the invention.

As shown on FIG. 12, the driving head 10 is a sleeve, one end of the sleeve has an opening 100 for purpose of fitting work pieces, and the other end of the sleeve is shaped polygonal 15 for fitting other tools.

Figure 13:
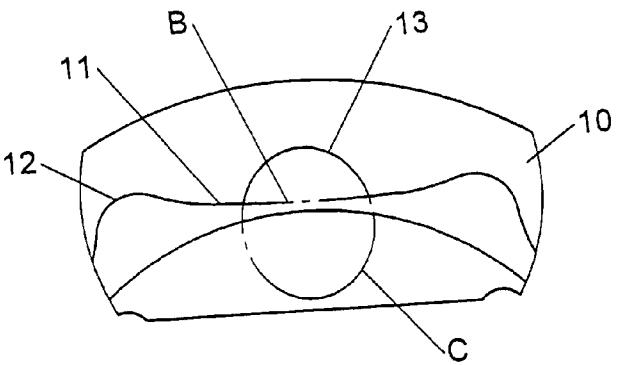
FIG. 13 is a partial enlarged view of another embodiment of the invention.

As shown on FIG. 13, the inside of the concavity 13 is an oval-shaped arc surface.

Figure 14:
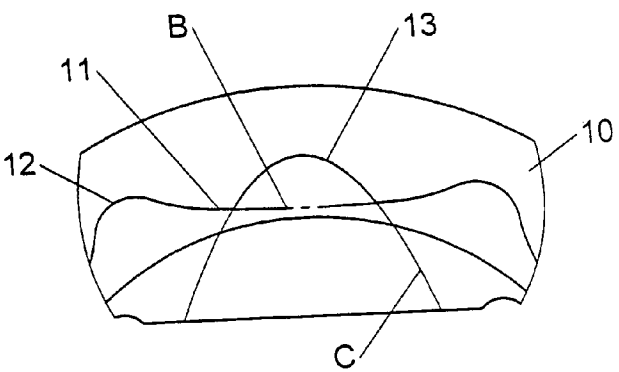
FIG. 14 is a partial enlarged view of another embodiment of the invention.

As shown on FIG. 14, the inside of the concavity 13 is a paraboloid.

Figure 15:
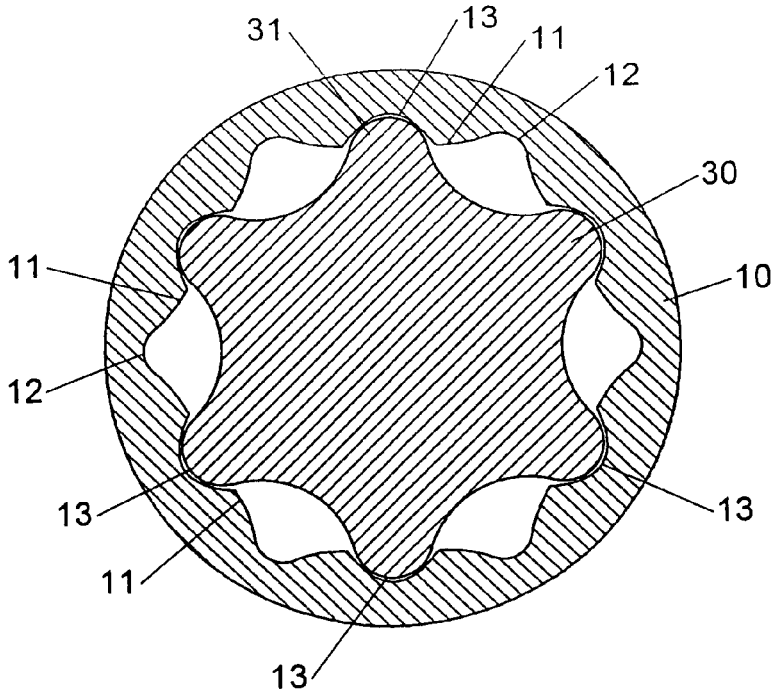
FIG. 15 shows the combination status of the work piece and the driving head of the invention.

As shown on FIG. 15, the concavity 13 still can fit the round extrusions 31 of the work piece 30

Figure 16:
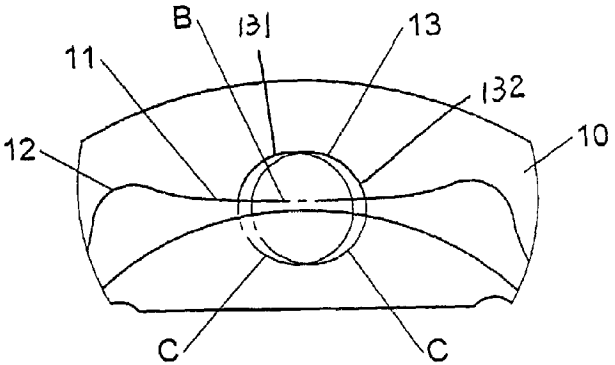
FIG. 16 is a partial enlarged view of another embodiment of the invention.

As shown on FIG. 16, the concavity 13 is composed by the two interconnected arc surface 131 and 132, which are round surfaces.

Figure 17:
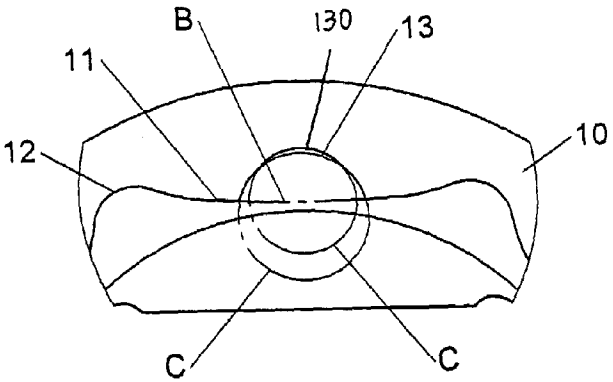
FIG. 17 is a partial enlarged view of another embodiment of the invention.

As shown on FIG. 17, a secondary concavity 130 is implemented inside the concavity 13, the secondary concavity 130 extends along the central axis, the inside of the concavity 13 and the secondary concavity 130 are both round, the radius of the concavity 13 is longer than that of the concavity 130.

Figure 18:
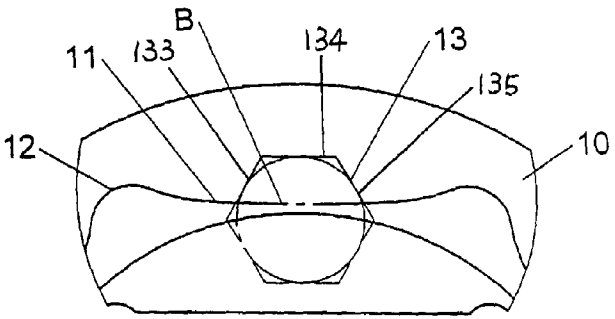
FIG. 18 is a partial enlarged view of another embodiment of the invention.

As shown on FIG. 18, the wall of the concavity 13 is formed by at least three surfaces 133, 134 and 135. The three surfaces can be arc surfaces in an embodiment, or can be flat surfaces as shown on FIG. 18, the angles formed by each two adjacent flat surfaces are all 120 degree.

Figure 20:
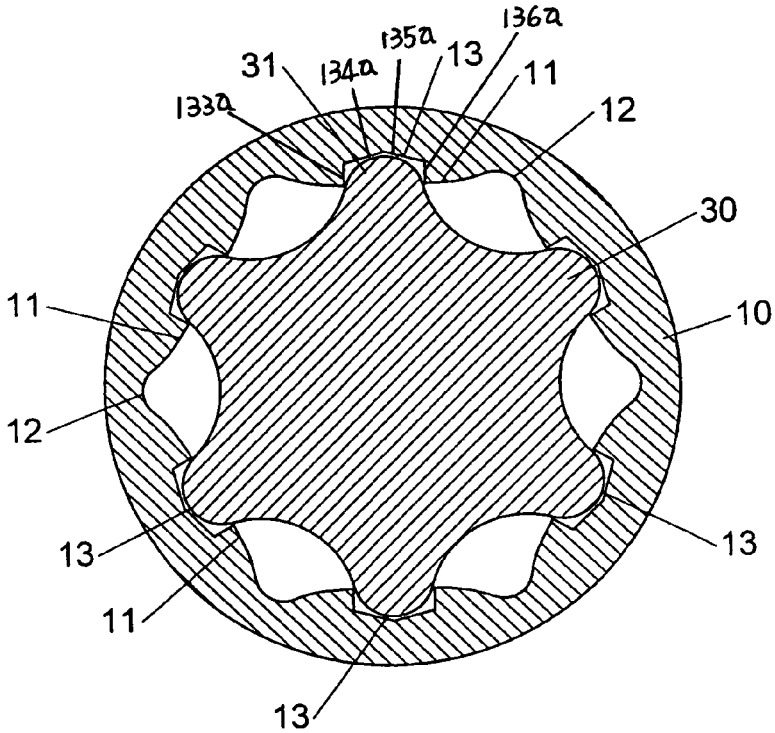
FIG. 20 shows the combination status of the work piece and the driving head of the invention.
Figure 19:
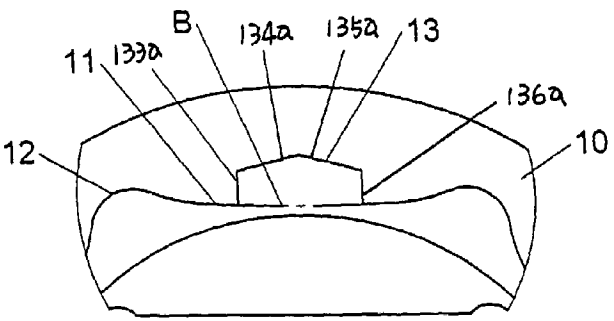
FIG. 19 is a partial enlarged view of another embodiment of the invention.

As shown on FIGS. 19 and 20, the wall of the concavity 13 is formed by four surfaces 133*a*, 134*a*, 135*a* and 136*a*, each of the surfaces is flat and at least one of the angles formed by each two adjacent flat surfaces is 120 degree, which will fit the round extrusions 31 of the work piece 30 as shown on FIG. 20.

Figure 21:
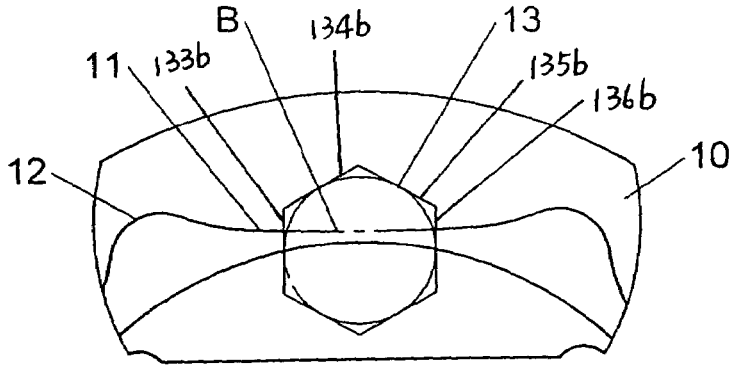
FIG. 21 is a partial enlarged view of another embodiment of the invention.
Figure 22:
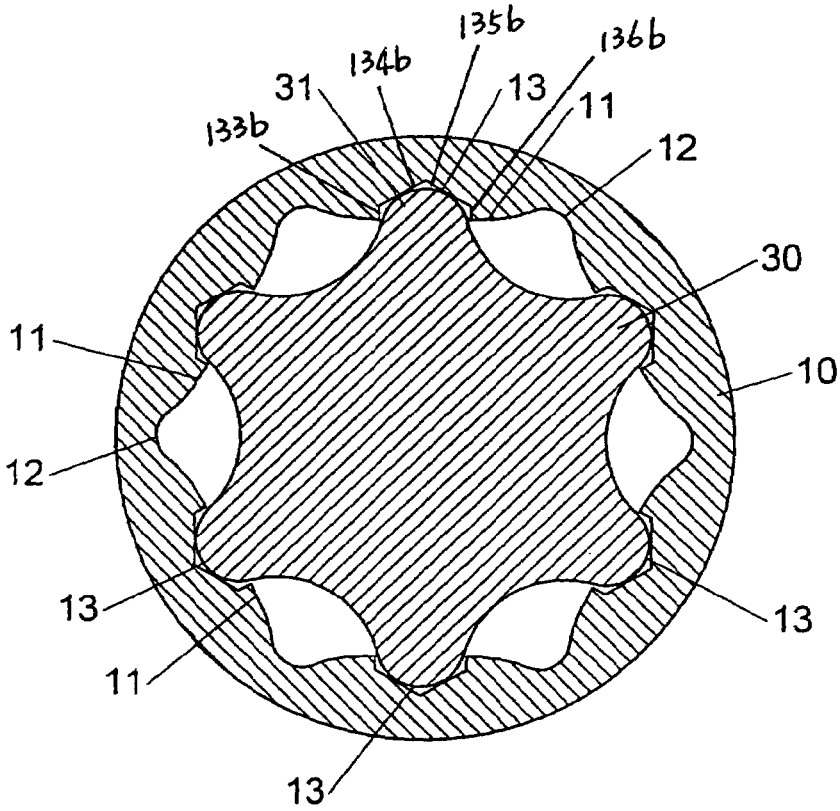
FIG. 22 shows the combination status of the work piece and the driving head of the invention.

As shown on FIGS. 21 and 22, the wall of the concavity 13 is formed by four surfaces 133*b*, 134*b* 135*b* and 136*b*, each of the surfaces is flat and the angles formed by each two flat surfaces are all 120 degree, which will fit the round extrusions 31 of the work piece 30 as shown on FIG. 22.

Figure 23:
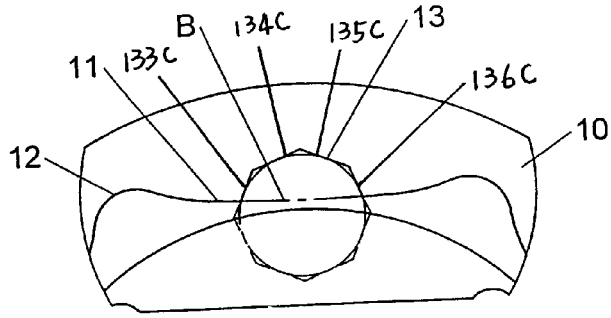
FIG. 23 is a partial enlarged view of another embodiment of the invention.

As shown on FIG. 23, the wall of the concavity 13 is formed by four surfaces 133*c*, 134*c*, 135*c* and 136*c*, each of the surfaces is flat and the angles formed by each two adjacent flat surfaces are all 135 degree.

Figure 24:
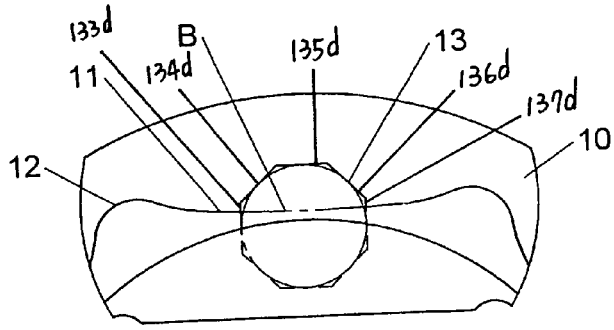
FIG. 24 is a partial enlarged view of another embodiment of the invention.

As shown on FIG. 24, the wall of the concavity 13 is formed by five surfaces 133*d*, 134*d*, 135*d*, 136*d* and 137*d*, each of the surfaces is flat and the angles formed by each two adjacent flat surfaces are all 135 degree.

Figure 25:
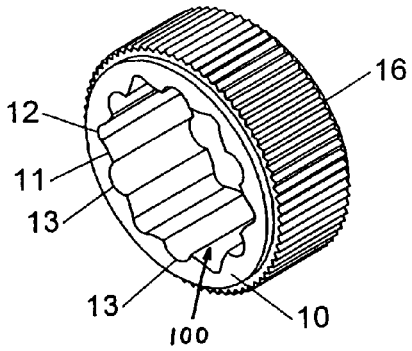
FIG. 25 is a 3-dimensional view of another embodiment of the invention.

As shown on FIG. 25, the driving head 10 is a sleeve with an opening 100 at one end, plurality ratchets 16 are implemented on the peripheral of outside of the sleeve.

Figure 26:
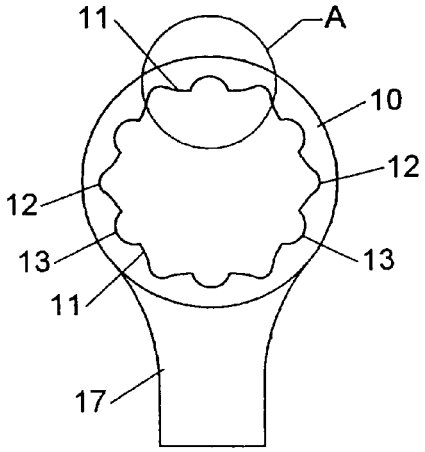
FIG. 26 is a front plan view shows the driving head with a handle.

As shown on FIG. 26, a handle 17 is implemented on one side of the driving head 10, which is to be used as an usual wrenching tool.

Figure 27:
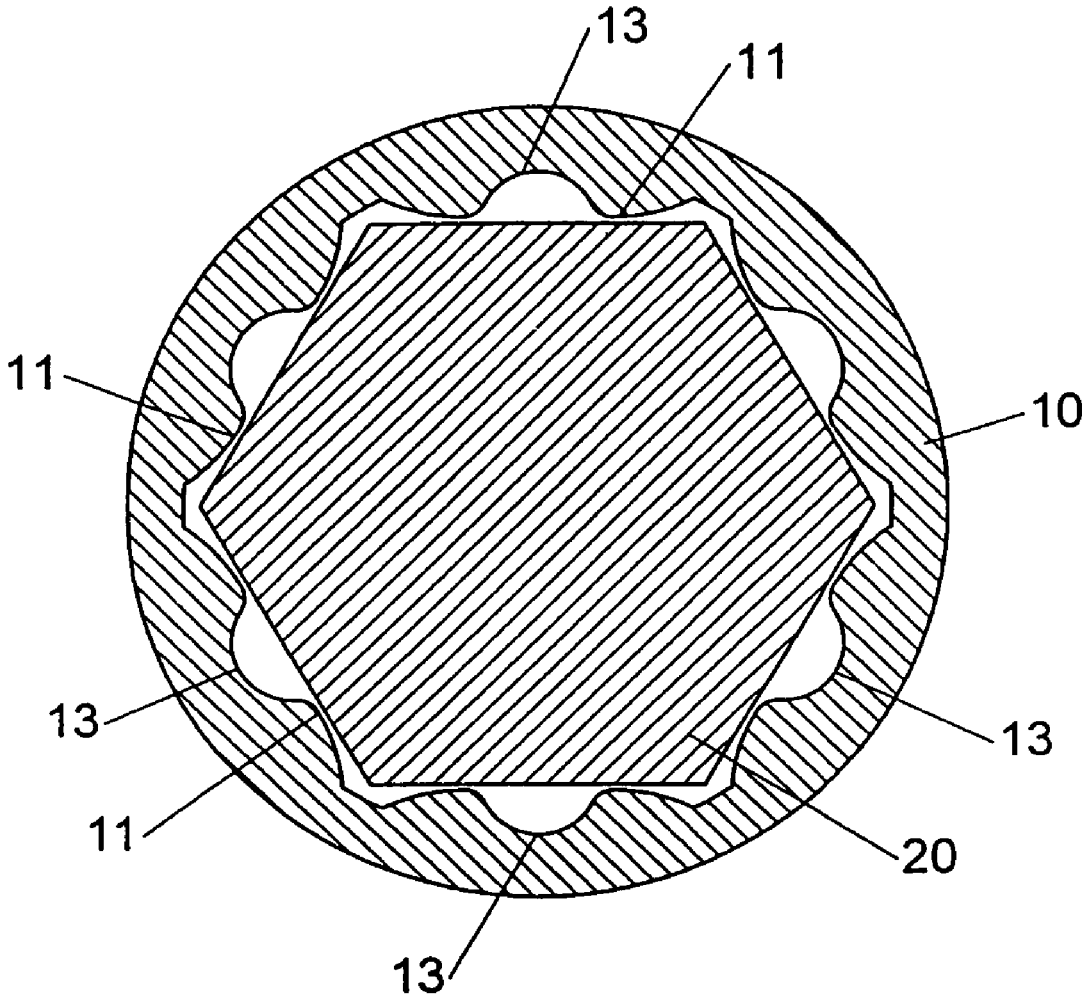
FIG. 27 shows the combination status of the work piece and the driving head of the invention.

As shown on FIG. 27, the two ends of the concavity 13 are connecting their neighboring forefront surfaces 11 to form continuous curves, the forefront surfaces 11 are formed by multiple curves for varieties of work pieces to fit.

Figure 28:
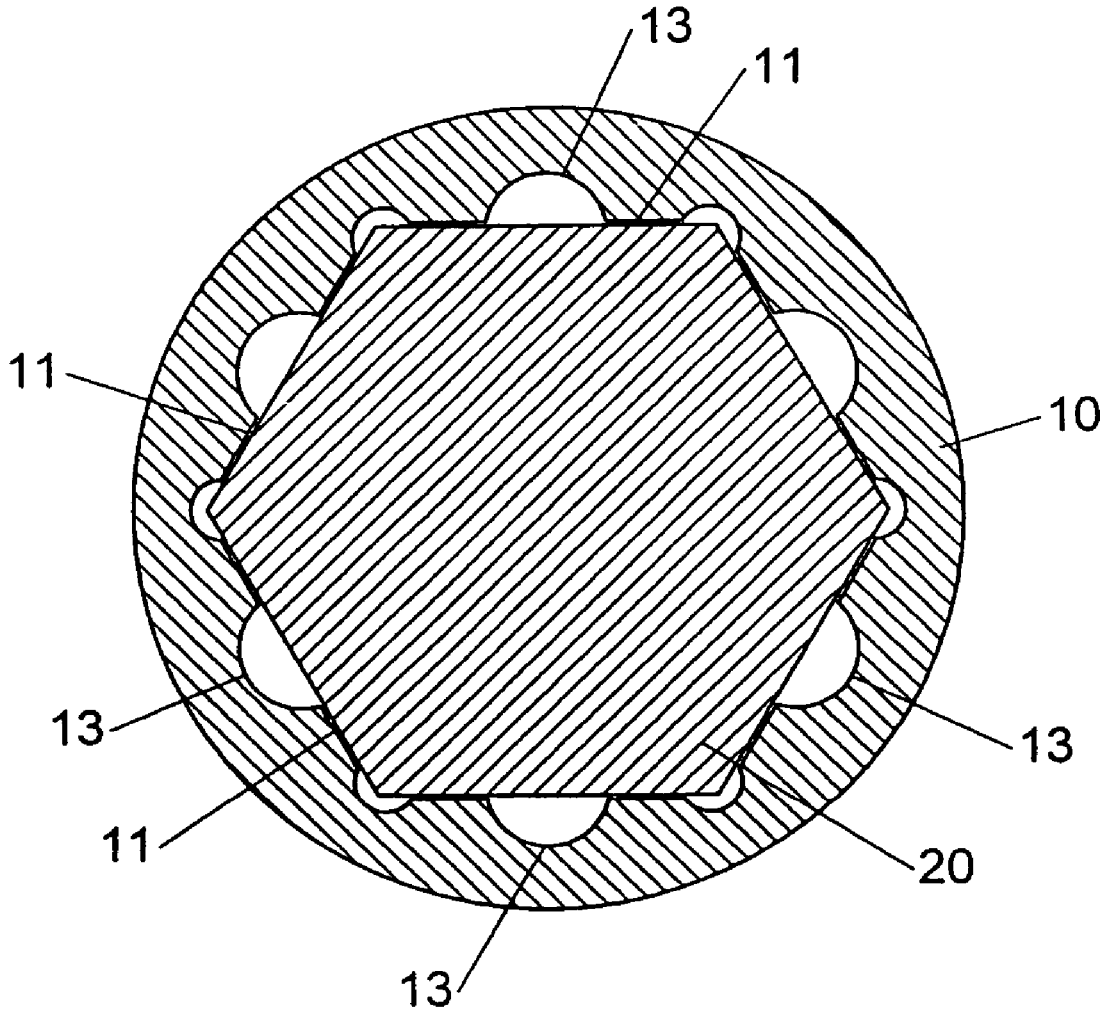
FIG. 28 shows the combination status of the work piece and the driving head of the invention.

As shown on FIG. 28, the forefront surfaces 11 are flat and there are six of them, with six forefront surfaces 11, which a hexagonal shape of work piece 20 can be fitted into.

What is claimed is:

1. A driving head of rotary wrenching tools having two opposite ends and having a central axis that connecting this two ends, at least one said end of the driving head having an opening extending along the central axis, the opening being for fining work pieces; the opening having plurality grooves that are distributed equidistant along the inner surface of the opening, the grooves extending along the central axis; at least a portion connecting every two adjacent said grooves forming a forefront surface, the forefront surface being closer to the central axis than the groove; at least a concavity being implemented on the center of each said forefront surface, and the extending direction of the concavity being parallel to the central axis and being deep enough to accommodate the extrusion parts of work pieces, and wherein the center of the concavity implements a deeper secondary concavity that is parallel to the central axis.

2. The driving head of claim 1 wherein each said forefront surface having one said concavity.

3. The driving head of claim 1 wherein the driving head is a sleeve, one end of the sleeve having said opening.

4. The driving head of claim 3 wherein the other end of the sleeve having a square hole.

5. The driving head of claim 3 wherein the other end of the sleeve having a polygonal opening.

6. The driving head of claim 1 wherein the forefront surface is a flat surface.

7. The driving head of claim 1 wherein the forefront surface is a curved surface.

8. The driving head of claim 1 wherein the inside of the groove is an arc surface.

9. The driving head of claim 1 wherein the forefront surface is an arc surface tangent to the arc surface of the groove.

10. The driving head of claim 1 wherein the concavity is a round-shaped arc surface.

11. The driving head of claim 1 wherein the concavity is an oval-shaped arc surface.

12. The driving head of claim 1 wherein the concavity is a paraboloid-shaped arc surface.

13. The driving head of claim 1 wherein the surface connecting the forefront surface and the concavities is shaped as a round corner.

14. The driving head of claim 1 wherein the concavity is composed by two interconnected arc surface.

15. The driving head of claim 14 wherein the two arc surface are round-shaped arc surfaces.

16. The driving head of claim 1 wherein the inside of the concavity and the secondary concavity are both round-shaped arc surfaces, the radius of the concavity is longer than the secondary concavity.

17. The structural improvement of the driving head of claim 1 wherein the driving head is a sleeve with an opening at one end, plurality ratchets are implemented on the peripheral of the outside of the sleeve.

18. The driving head of claim 1 wherein the driving head extends a handle on one side.

19. A driving head of rotary wrenching tools having two opposite ends and having a central axis that connecting this two ends; at least one end of the driving head having an opening along the central axis, the opening of the driving head being for fitting work pieces; the opening having plurality grooves that are distributed equidistant along the inner surface of the opening, the grooves extending along the axis; at least a portion connecting every two adjacent grooves forming a forefront surface, the forefront surface being closer to the central axis than the groove; at least a concavity being implemented on the center of each forefront surface, the extending direction of the concavity being parallel to the central axis and being deep enough to accommodate the extrusion parts of work pieces; the wall of the concavity being formed by at least three surfaces, wherein the surfaces of the concavity are flat surfaces, and at least one of the angles formed by two adjacent said flat surfaces is 120 degree.

20. The driving head of claim 19 wherein the angles formed by each two adjacent said flat surfaces are all 120 degree.

21. The driving head of claim 19 wherein the number of the flat surfaces is four.

22. A driving head of rotary wrenching tools having two opposite ends and having a central axis that connecting this two ends; at least one end of the driving head having an opening along the central axis, the opening of the driving head being for fitting work pieces; the opening having plurality grooves that are distributed equidistant along the inner surface of the opening, the grooves extending along the axis; at least a portion connecting every two adjacent grooves forming a forefront surface, the forefront surface being closer to the central axis than the groove; at least a concavity being implemented on the center of each forefront surface, the extending direction of the concavity being parallel to the central axis and being deep enough to accommodate the extrusion parts of work pieces; the wall of the concavity being formed by at least three surfaces, wherein the wall of the concavity is formed by five surfaces, each surface is flat, and the angles formed by each two adjacent said flat surfaces are all 135 degree.

23. The structural improvement of the driving head of claim 22 wherein the driving head is a sleeve with one said opening at one end, plurality ratchets are implemented on the peripheral of outside of the sleeve.

24. The driving head of claim 22 wherein a handle is implemented on one side of the driving head, which is to be used as an usual wrenching tool.

* * * * *